United States Patent [19]

Tanner

[11] 4,257,472

[45] Mar. 24, 1981

[54] CONTINUOUS CASTING OF HOLLOW SHAPES

[75] Inventor: Heinrich Tanner, Herisau, Switzerland

[73] Assignee: Concast Incorporated, Montvale, N.J.

[21] Appl. No.: 62,084

[22] Filed: Jul. 30, 1979

[51] Int. Cl.[3] ..... B22D 11/124; B22D 11/128

[52] U.S. Cl. ..... 164/70; 164/85

[58] Field of Search ..... 164/85, 421, 447, 70

[56] References Cited

U.S. PATENT DOCUMENTS

| | | | |
|---|---|---|---|
| 1,773,429 | 8/1930 | Lindsey | 164/85 X |
| 2,473,221 | 6/1949 | Rossi | 164/85 |
| 3,078,527 | 2/1963 | Valyi et al. | 164/85 X |
| 3,421,569 | 1/1969 | Neumann | 164/86 |
| 3,593,773 | 7/1971 | Vogt et al. | 164/4 |
| 3,604,498 | 9/1971 | Bollig | 164/85 X |
| 3,638,715 | 2/1972 | Simons | 164/85 |
| 3,661,196 | 5/1972 | Kummant | 164/85 |
| 3,708,010 | 1/1973 | Simons | 164/83 X |
| 3,713,478 | 1/1973 | Vogt et al. | 164/85 |
| 3,886,996 | 6/1975 | Tseitlin | 164/85 X |

FOREIGN PATENT DOCUMENTS

| | | | |
|---|---|---|---|
| 1783146 | 10/1972 | Fed. Rep. of Germany . | |
| 1758466 | 3/1975 | Fed. Rep. of Germany . | |
| 37-62 | 1/1962 | Japan | 164/85 |
| 422522 | 10/1974 | U.S.S.R. . | |
| 428817 | 10/1974 | U.S.S.R. . | |
| 448055 | 11/1974 | U.S.S.R. | 164/85 |

*Primary Examiner*—Robert D. Baldwin

*Attorney, Agent, or Firm*—Tobias Lewenstein

[57] ABSTRACT

An apparatus for the continuous casting of hollow metal shapes includes a cooled, open-ended mold having a cooled mandrel positioned centrally of the mold cavity. The inner surface of the mold and outer surface of the mandrel together define a casting space. Molten metal is teemed into this space and solidifies adjacent the inner surface of the mold and the outer surface of the mandrel. In this manner, a body consisting of a molten mass confined between a pair of solidified skins is formed. The body is continuously withdrawn from the mold thereby generating a continuous strand which is hollow due to the presence of the mandrel in the mold. The outer surface of the strand is sprayed with coolant outside of the mold so that the molten mass within the strand solidifies progressively. The mandrel is provided with a passage which opens to the hollow center of the strand and a finely divided solid such as sand is fed into the center of the strand via this passage. The solid forms a core which provides a certain degree of support for the inner surface of the strand and extracts a certain amount of heat from the latter. After solidification of the strand, the latter is cut into sections and the core is removed to yield hollow shapes.

13 Claims, 2 Drawing Figures

CONTINUOUS CASTING OF HOLLOW SHAPES

FIELD OF THE INVENTION

The invention relates generally to the continuous casting of metals, e.g. steels.

More particularly, the invention relates to the continuous casting of hollow metal shapes.

BACKGROUND OF THE INVENTION

The continuous casting of hollow metal shapes is performed in an apparatus provided with a cooled, open-ended mold having a cooled mandrel positioned centrally of the mold cavity. The inner surface of the mold and outer surface of the mandrel cooperate to define a casting space. Molten metal is continuously teemed into the casting space and solidifies adjacent both the inner surface of the mold and the outer surface of the mandrel. This results in a body consisting of a molten mass confined between a pair of spaced, solidified skins.

The body is continuously withdrawn from the casting space thereby generating a continuous, partially solidified strand. The strand is hollow due to the presence of the mandrel in the mold.

In order to accelerate the solidification of the strand, the outer surface of the strand is sprayed with a coolant, typically water, outside of the mold. Once the strand has solidified throughout, it is cut into sections and then subjected to further processing.

One of the problems with the procedure outlined above resides in that the rate of heat extraction from the strand is relatively low inasmuch as heat is removed only via the outer surface of the strand. Since the strand must be solidified throughout before it can be cut, the casting speed must be kept relatively low to insure that complete solidification occurs before the cutting operation. This leads to low production rates. Furthermore, a low rate of heat extraction gives rise to the danger that the inner skin of the strand will remelt thereby permitting the molten metal within the strand to escape. In such an event, the casting operation must be terminated resulting in economic penalties from the points of view of lost material and lost production time.

Another problem with the foregoing procedure stems from the pressure generated by the molten metal within the strand. The pressure may cause the inner skin to bulge or, even worse, to burst, thereby permitting the molten metal to flow out. Bulges on the inner surface of the strand are undesirable from a quality standpoint while the escape of molten metal has the economic consequences indicated earlier. This problem may be avoided for the outer skin of the strand since the outer skin is readily accessible and may be suitably supported if considered necessary to prevent bulging or bursting.

In order to improve the rate of heat extraction from the strand, it has been proposed to spray the inner surface of the strand with water. The water is brought to the interior of the strand via conduits passing through the mandrel. Aside from the benefits which may be realized vis-a-vis casting speed and remelting of the inner skin of the strand, such spraying can lead to an improvement in the internal structure of the strand. However, the problem of bulging and/or bursting of the inner skin of the strand is not overcome by spraying of the inner surface. In the casting of steel, this can have particularly severe consequences since bursting of the inner skin may cause an explosion if the cooling water and molten steel come into contact. In addition, the pipes for the cooling water have sections which extend from the mandrel to the respective water inlet and outlet connections. These pipe sections, of necessity, are located above the bath of molten metal in the mold. Should a break occur so that the cooling water contacts the bath, there may be splattering or, in the case of a steel bath, possibly an explosion. Moreover, since the inner surface of the strand is invisible, it is difficult to determine when changes in the cooling intensity within the strand are required.

A proposal which avoids the danger of explosion and, at least to an extent, the problem of bulging and/or bursting of the inner skin of the strand involves the use of a low-melting point metal as a cooling medium for the inner surface of the strand. Here, a rod having a smaller diameter than the mandrel is aligned with the latter and is located on the longitudinal axis of the strand. The rod, which has an end located within the mold adjacent the mandrel, extends away from the mandrel in the direction of casting. A hollow dummy bar, which is used to start the strand, fits on the rod and is mounted for movement along the same.

The inner surface of the strand and the outer surface of the rod cooperate to define an annular space and the dummy bar has a passage which communicates with this space. The passage is connected to a reservoir via a length of flexible tubing. The reservoir, which has a heat-exchanger and accommodates a low-melting point metal, is also in communication with a central passage formed in the mandrel. The central passage, in turn, opens to the annular space between the rod and the strand. A pump is arranged in the line running from the reservoir to the mandrel.

In operation, a continuously cast strand is started by the dummy bar. Although the dummy bar is connected to the reservoir, it is free to move away from the mold since the connection is formed by flexible tubing. The low-melting point metal contained in the reservoir, which has been heated to a temperature above its melting point, is pumped through the mandrel and into the annular space between the rod and the strand where it absorbs heat from the latter. The liquid metal coolant is subsequently returned to the reservoir via the passage provided for this purpose in the dummy bar. In the reservoir, heat is removed from the liquid metal coolant by means of the heat-exchanger. Thereafter, the liquid metal coolant is recirculated.

While the above apparatus does avoid the danger of explosion and reduce the risk of bulging and/or bursting of the inner skin of the strand, it has the disadvantages of great complexity and high cost. To begin with, the cooling system must be designed with the capability of handling a coolant which is in the form of molten metal. Moreover, not only is it necessary to provide a means for removing heat from the liquid metal coolant but it is further necessary to provide a means for remelting the coolant in the event that the apparatus has been idle for a while. In addition, sliding seals are required between the dummy bar and the rod on which it is mounted in order to prevent leakage of the liquid metal coolant between the dummy bar and the rod. Such seals are difficult to maintain. There are also operational difficulties associated with the foregoing apparatus. Thus, care must be exercised in disconnecting the dummy bar from the strand since, if not done properly, the liquid metal coolant may escape. Also, cooling is no longer possible once the dummy bar has been disconnected from the strand. Additionally, there is no assurance that the gap between the inner surface of the strand and the outer surface of the rod will be uniform. Should the gap, and consequently the cooling effect, be non-uniform, the internal structure of the strand may be adversely affected.

Aside from the foregoing observations regarding the known methods and apparatus, none are intended to control the properties of the inner surface of a continuously cast hollow strand.

OBJECTS OF THE INVENTION

It is an object of the invention to provide a method and an apparatus which make it possible to reduce the risk of bulging and/or bursting of the inner skin of a continuously cast hollow strand in a simple manner.

Another object of the invention is to provide a method and an apparatus which make it possible to cool the inner surface of a continuously cast hollow strand in a simple manner.

An additional object of the invention is to provide a method and an apparatus which make it possible to support and cool the inner surface of a continuously cast hollow strand in a simple manner and with little risk of spattering or explosion.

It is also an object of the invention to provide a method and an apparatus which make it possible to support and cool the inner surface of a continuously cast hollow strand while imparting a desired property to this surface.

SUMMARY OF THE INVENTION

These and other objects are achieved by the invention.

A method according to the invention involves the introduction of a finely divided solid into the hollow interior of a continuously cast hollow strand. The solid is removed from the strand after the latter has solidified.

The solid forms a core which offers a certain degree of support for the inner skin of the strand and also withdraws a certain amount of heat therefrom. The supporting function of the solid may be enhanced by conveying the solid into the hollow interior of the strand under conditions which cause a pressure to exist in the core, e.g. by conveying the solid via a compressed gas. The cooling function of the solid may be enhanced by selecting a solid which undergoes an endothermic transformation, such as melting or a change in crystal structure, inside the strand. This will cause a quantity of heat equal to the heat of transformation of the solid to be removed from the strand. An endothermic transformation of the solid is particularly advantageous in the critical region near the mold where rapid growth of the thin inner skin is desirable.

The invention also makes it possible to control the properties of the strand by appropriate selection of the solid. For example, it is possible to carburize the inner surface of the strand by choosing carbon as the solid. Furthermore, by selecting the solid so that it does not undergo violent reaction with the molten metal being cast, the risk of explosion may be greatly reduced.

An apparatus according to the invention includes a mandrel having a passage which opens to the hollow interior of the strand. A source of a finely divided solid is provided as are means for supplying the solid to the hollow interior of the strand via the passage in the mandrel.

DESCRIPTION OF THE PREFERRED EMBODIMENTS

Figure 1:
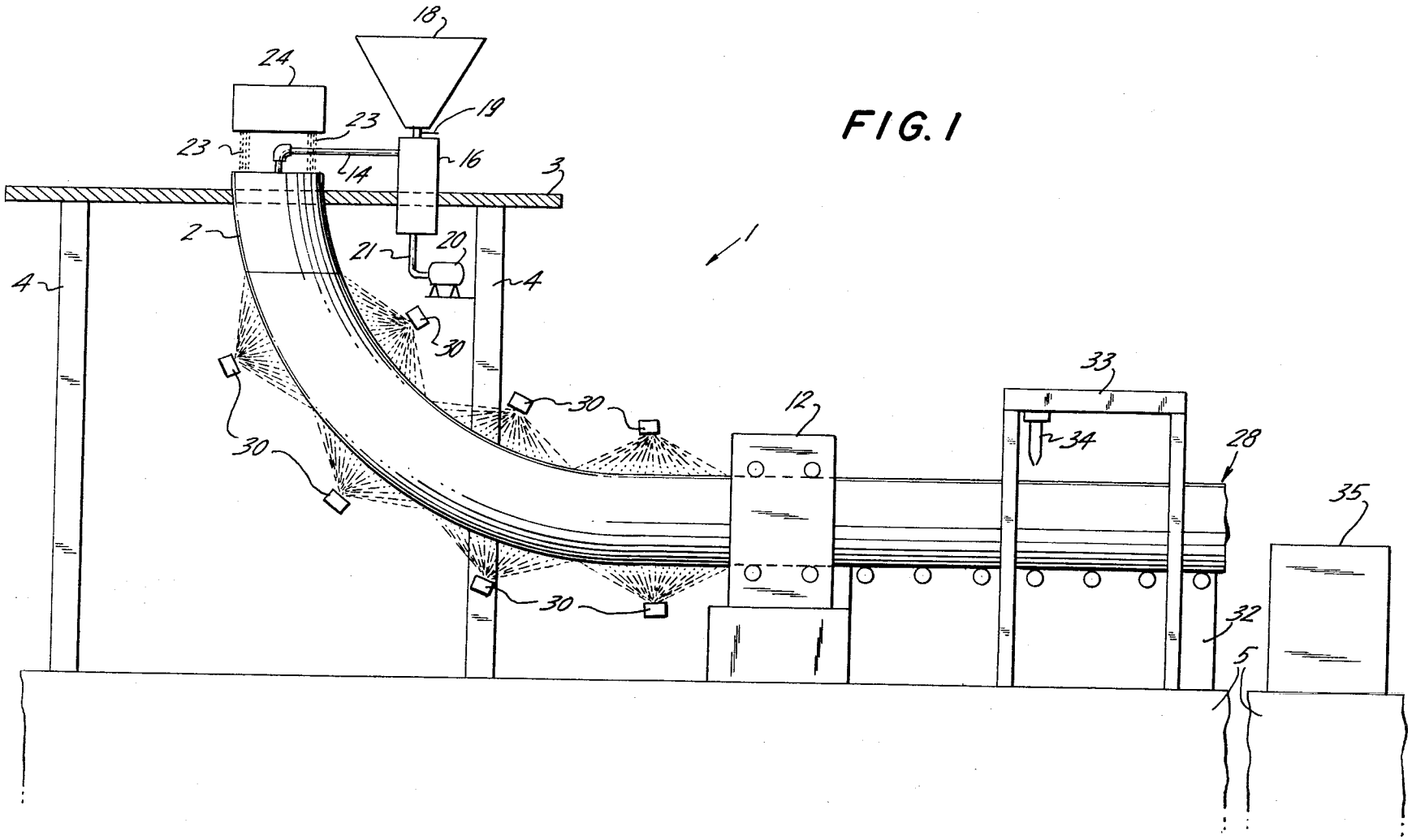
FIG. 1 is a schematic, partially sectional side view of a plant according to the invention for the production of hollow shapes via the continuous casting route.

FIG. 1 shows a plant for the production of hollow metal shapes, e.g. steel shapes, via the continuous casting route. It is assumed here that the plant of FIG. 1 is directed towards the production of hollow rounds. However, other hollow shapes, such as polygonal shapes, may be produced using the principles of the invention.

The plant of FIG. 1 includes a continuous casting installation which is identified generally by the reference numeral 1. The installation 1 has a cooled, open-ended mold 2 of the curved type. The mold 2, which has a circular cross-section and a generally vertical orientation, is supported on a casting platform 3. The casting platform 3 is mounted on beams 4 which are secured in a foundation 5.

Figure 2:
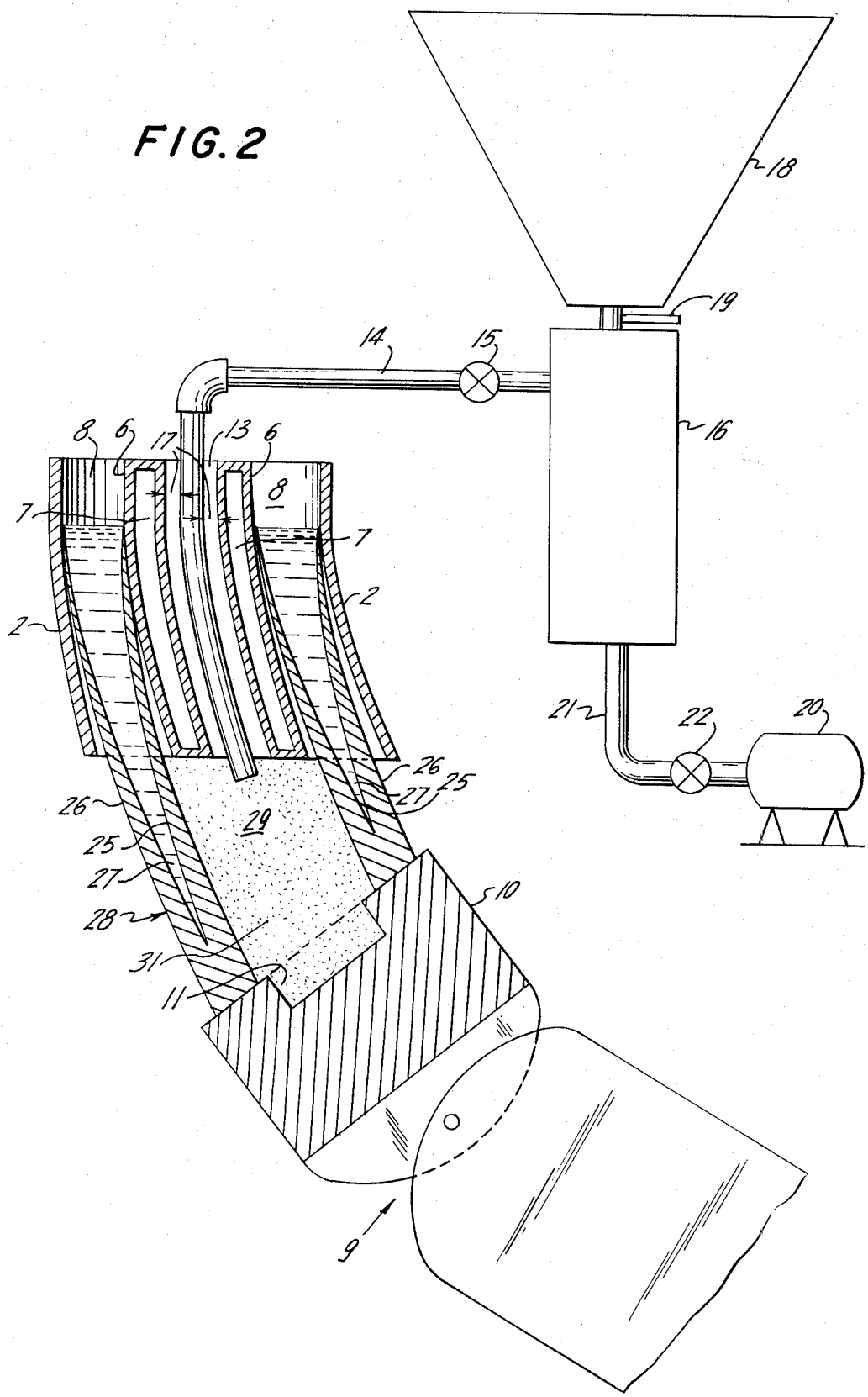
FIG. 2 is an enlarged, partially sectional side view illustrating the formation of a hollow shape in the plant of FIG. 1.

As seen in FIG. 2, the mold 2 surrounds and is concentric with a circular mandrel 6. The mandrel 6, which is supported by the mold 2 in conventional manner, has an internal chamber 7 for the circulation of a coolant. The mold 2 and mandrel 6 are spaced from one another and cooperate to define an annular casting space 8 between them.

The casting installation 1 further includes a dummy bar 9 having a dummy bar head 10 which closes the lower end of the casting space 8 at the beginning of a casting operation. The dummy bar head 10 is provided with a recess 11 which fits around the mandrel 6. The dummy bar 9 is driven towards and away from the mold 2 by means of a withdrawal and straightening unit 12 forming part of the casting installation 1.

In accordance with the invention, the mandrel 6 is provided with an open-ended, central passage 13 extending in axial direction thereof. A pipe 14 provided with a valve 15 projects into the passage 13. One end of the pipe 14 is connected with an upright fluidizing reactor 16 while the other end of the pipe 14 is located in the region of the lower end of the mandrel 6. The diameter of the pipe 14 is smaller than that of the passage 13 so that an annular gap 17 exists between the pipe 14 and the inner surface of the mandrel 6.

The upper end of the fluidizing reactor 16 is connected with a hopper 18 which serves as a source of a finely divided solid. A slide valve 19 is arranged in the connection between the fluidizing reactor 16 and the hopper 18. The lower end of the fluidizing reactor 16 is connected with a source 20 of compressed gas via a pipe 21 having a valve 22.

In operation, the dummy bar 9 is positioned so that the lower end of the mandrel 6 is received in the recess 11 of the dummy bar head 10 which closes the lower end of the casting space 8. One or more streams 23 of molten metal are now continuously teemed into the casting space 8 from a vessel 24, such as a tundish, positioned above the mold 2.

The initial quantity of molten metal teemed into the casting space 8 solidifies in contact with the dummy bar head 10 and becomes anchored to the latter via conventional, non-illustrated anchoring devices provided thereon. Solidification occurs throughout the cross-section of the casting space 8 since the dummy bar head 10 is cold and has a large mass. Subsequent quantities of molten metal teemed into the casting space 8 undergo solidification only in the regions of the cooled surfaces of the mold 2 and mandrel 6. This results in a partially solidified body composed of solid, generally concentric, annular inner and outer skins 25 and 26 which surround a molten center 27.

When the molten metal in the casting space 8 reaches a predetermined level, the mold 2 and mandrel 6 are reciprocated in known manner and the dummy bar 9 is drawn away therefrom. The rate of withdrawal of the dummy bar 9 is matched to the rate of introduction of molten metal into the casting space 8. The dummy bar 9 travels along a curved path which corresponds to a continuation of the radius of curvature of the mold 2.

The withdrawal of the dummy bar 9 causes a continuous strand 28 to be generated. Due to the presence of the mandrel 6, the strand 28 issuing from the casting space 8 has a hollow interior 29. The strand 28 is not solidified throughout upon leaving the casting space 8 but contains the molten center 27. The latter generates a metallostatic pressure which acts upon the inner and outer skins 25 and 26 of the strand 28.

The outer skin 26 of the strand 28 is sprayed with coolant, typically water, once the strand 28 has exited from the casting space 8. This aids in solidification of the molten center 27 of the strand 28. The coolant is supplied from spray nozzles 30 positioned above and below, as well as to the sides of, the strand 28. The outer skin 26 may be supported by rolls or other devices if necessary to prevent bulging and/or bursting thereof due to the metallostatic pressure generated by the molten center 27.

In accordance with the invention, a finely divided solid is conveyed into the hollow interior 29 of the strand 28. This is effected in that pressurized gas is permitted to flow from the gas source 20 into the fluidizing reactor 16 while the solid is fed from the hopper 18 into the reactor 16 in controlled amounts. The solid is fluidized in the reactor 16 and then travels through the pipe 14 into the hollow interior 29 of the strand 28 where it forms a core 31. The core 31 withdraws a certain amount of heat from the strand 28 thus assisting in the solidification of the molten center 27 thereof and reducing the risk of remelting of the inner skin 25. In addition, the core 31 offers a certain degree of support for the inner skin 25 against the metallostatic pressure exerted by the molten center 27.

The strength of the inner skin 25 is less in the region immediately below the mold 2 than at any other location outside of the casting space 8. In order to obtain enhanced support for the inner skin 25 in the critical region near the mold 2, it is advantageous for the pressure of the gas from the source 20 to be such that the total outwardly directed pressure exerted on the inner skin 25 in this critical region equals or slightly exceeds the metallostatic pressure generated by the molten center 27. Excessive outwardly directed pressure on the inner skin 25 should be avoided so that the inner skin 25 will not undergo undue bulging in the outward direction.

The solid continues to be admitted into the hollow interior 29 of the strand 28 as the latter is withdrawn from the casting space 8. The rate of introduction of the solid into the hollow interior 29 is matched to the rate of withdrawal of the strand 28 from the casting space 8. The conveying gas escapes from the hollow interior 29 via the gap 17 between the pipe 14 and the inner surface of the mandrel 6.

Instead of conveying the solid by means of a compressed gas, it is possible to feed the solid into the hollow interior 29 of the strand 28 via gravity. Another possibility is to provide a mechanical conveyor for the solid.

The strand 28, together with its core 31, is conveyed along the curved path followed by the dummy bar 9 until the strand 28 reaches the withdrawal and straightening unit 12. Here, the strand 28 is straightened and then travels along a horizontal path. After the strand 28 has been engaged by the unit 12, the dummy bar 9 and the strand 28 are disconnected from one another. The unit 12 thereafter continues withdrawing the strand 28 from the casting space 8 by acting directly on the strand 28. The distance between the casting space 8 and the unit 12 is preferably chosen such that the strand 28 is solidified throughout before reaching the unit 12.

After leaving the unit 12, the strand 28 travels on a roller table 32 to a cutting station 33 where it is cut into sections. The cutting station 33 includes a cutting device 34 which is here shown as being in the form of a travelling torch but may also be in the form of travelling shears. The cut sections are conveyed away from the cutting station 33 on the roller table 32.

The cut sections of the strand 28 are subsequently processed so as to remove the core 31 therefrom. If the core 31 is loosely packed, this may simply involve upending the cut sections and possibly lightly machining the hollow interiors thereof to remove any residues adhering to the respective inner surfaces. In fact, if the core 31 is loosely packed, a portion of the core 31 may be jolted out of the cut sections during travel of the latter along the roller table 32. On the other hand, if the core 31 is compacted to such an extent that it cannot be removed by upending the cut sections, the cut sections are brought to a trepanning device 35 for removal of the core 31.

It may be necessary to machine away the inner surface layers of the cut sections in the event that the presence of the core 31 results in undesired alloying or reaction at the inner surface of the strand 28.

After removal of the core 31, the cut sections are further processed as required to meet particular applications.

From an economic point of view, it may be desirable to recycle the solid constituting the core 31. In such a case, the solid is collected upon removal from the cut sections and subsequently treated if necessary to return it to finely divided form. The solid may then be returned to the hopper 18.

The finely divided solid may be an essentially pure element, an alloy, a compound or a mixture of different materials. With respect to the characteristics of the solid, there are several possibilities including the following:

1. The solid may be essentially inert relative to the strand and simply undergo heating in the latter. Illustrative of solids of this type are casting sand and the oxide or oxides corresponding to the metal being cast, e.g. ferric oxide in the case of steel.

2. The solid may be capable of causing a beneficial reaction in the strand. For instance, should it be desirable to carburize the inner surface of a hollow shape, the solid might be in the form of carbon.

3. The solid may be capable of undergoing an endothermic transformation inside the strand. Such a transformation will cause a quantity of heat equal to the heat of transformation to be withdrawn from the strand in addition to the heat withdrawn due to heating of the solid to the transformation point. The transformation may involve melting of the solid or a change in the crystal structure thereof. It is also possible for the solid to undergo a change in crystal structure and subsequently melt.

An endothermic transformation is particularly advantageous in the critical region near the mold where remelting of the inner skin is prone to occur.

A quantity of heat equal to the heat of transformation is liberated when the solid reverts back to its original state. The transformation point should be such that the reversion either occurs at a location inside the strand where the risk of remelting of the inner surface by the liberated heat of transformation is small or occurs after removal of the solid from the strand.

In the case of a solid which melts inside the strand, the transformation point, that is, the melting point, is preferably selected so that resolidification occurs before the strand is cut into sections. Otherwise, the molten phase of the solid will flow out of the strand fouling the casting machine and essentially nullifying the attempt to maintain a core in the hollow interior of the strand. The melting point should thus be higher than the temperature of the strand as this enters the cutting station. It is preferred for the melting point to lie roughly midway between the temperature of the strand as this enters the cutting station and the temperature of the strand as the latter emerges from the mold. This should allow at least partial melting of the solid in the region near the mold while permitting resolidification before the cutting station.

In the case of a solid which undergoes a change in crystal structure inside the strand, the transformation point is most desirably below the temperature of the strand as the latter enters the cutting station. The reversion of the solid to its original state will then occur either after the strand has been cut into sections and is well able to absorb the liberated heat of transformation or after the solid has been removed from the strand. If a solid having a transformation point below the temperature at the cutting station cannot be used, it is possible to use a solid having a transformation point above such temperature. The transformation point in such an event is preferably as close as possible to the temperature at the cutting station.

The transformation point in all cases is, of course, lower than the temperature of the strand as this emerges from the mold.

The solids which may be used in a particular instance to obtain a transformation inside a strand will depend upon the melting point of the metal being cast, the temperature of the strand as this emerges from the mold and the temperature of the strand as this enters the cutting station. The latter two temperatures, in turn, depend on the casting conditions so that they will lie within respective ranges for any given metal.

The selection of a solid to obtain a transformation inside a strand will be illustrated using the casting of steel as an example. A great variety of steels, including carbon and low alloy steels, melt in the temperature range of approximately 1400° to 1550° C. Since the temperature of a steel strand as it emerges from the mold is roughly 50° to 100° C. below the melting point of the steel, the temperature of the strand upon emergence from the mold may be considered to lie roughly in the range of 1300° to 1510° C. The temperature of the strand upon entering the cutting station is approximately in the range of 595° to 845° C. Representative solids which may be used under these conditions are listed below together with the appropriate transformation point or points in °C:

A. Solids which undergo melting
1. Copper—1083.
2. Mixture containing 40 percent by weight of aluminum and 60 percent by weight of antimony—970.
3. Alloy containing 20 percent by weight of nickel and 80 percent by weight of tin—1060.
4. Potassium sulfate—1075.

B. Solids which undergo a change in crystal structure
1. Iron;
alpha-to-gamma—910.
gamma-to-delta—1390.
This substance is particularly well-suited for the casting of steel.
2. Titanium;
alpha-to-beta—883.
3. Calcium Metasilicate;
beta-to-alpha—1200.

C. Solids which undergo a change in crystal structure followed by melting
1. Manganese;
alpha-to-beta—678.
beta-to-gamma—1100.
gamma-to-delta—1138.
delta-to-liquid—1260.
2. Alloy containing 11.8 percent by weight of aluminum and 88.2 percent by weight of copper;
alpha+gamma-to-beta—565.
beta-to-liquid—1045.
3. Barium chloride;
monoclinic-to-cubic—925.
cubic-to-liquid—962.

The solid is preferably selected so that it does not cause a reaction which adversely affects the strand. Furthermore, when the hollow interior of the strand opens to the casting shop atmosphere via the passage in the mandrel, the solid should not generate undesirable fumes upon heating. This consideration declines in importance if an exhaust pipe is provided around the feed pipe for the solid and seals the passage in the mandrel from the casting shop atmosphere.

The gas used to convey the solid into the hollow interior of the strand may be air in which event the source of compressed gas may be an air compressor. Another possibility is to use an inert gas such as nitrogen or argon to convey the solid into the hollow interior of the strand. It is further conceivable to convey the solid into the hollow interior of the strand using pressurized steam.

I claim:

1. A method of continuously casting hollow shapes comprising the steps of:

(a) continuously admitting molten metal into an open-ended casting space circumferentially bounded by inner and outer surfaces;

(b) cooling said surfaces to form a body having solidified inner and outer skins which confine a mass of said molten metal;

(c) withdrawing said body from said casting space to generate a continuous, partially solidified strand having a hollow interior;

(d) conveying a finely divided solid into said hollow interior to form a core which supports said inner skin and withdraws heat therefrom by undergoing an endothermic transformation within said hollow interior; and (e) removing said core after said strand has solidified.

2. A method as defined in claim 1, wherein said strand is cut into sections subsequent to solidification thereof and the removing step is performed after the cutting step.

3. A method as defined in claim 1, wherein the conveying step comprises fluidizing said solid in a pressurized gaseous medium.

4. A method as defined in claim 3, wherein said gaseous medium comprises air or an inert gas or steam.

5. A method as defined in claim 1, wherein the conveying step comprises feeding said solid by gravity.

6. A method as defined in claim 1, wherein the conveying step comprises feeding said solid mechanically.

7. A method as defined in claim 1, wherein said solid is substantially inert with respect to said strand.

8. A method as defined in claim 1, wherein said solid melts in said hollow interior of said strand.

9. A method as defined in claim 8, wherein said strand is cut into sections subsequent to solidification thereof and said solid resolidifies before the cutting step.

10. A method as defined in claim 1, wherein said solid undergoes an endothermic change in crystal structure in said hollow interior of said strand.

11. A method as defined in claim 10, wherein said strand is cut into sections subsequent to solidification thereof and said solid retransforms after the cutting step.

12. A method as defined in claim 11, wherein said solid retransforms after the removing step.

13. A method as defined in claim 10, wherein said metal is steel and said solid comprises iron.

* * * * *